United States Patent [19]

Tuggle et al.

[11] Patent Number: 4,508,068

[45] Date of Patent: Apr. 2, 1985

[54] FUEL MIXTURE ENRICHMENT SYSTEM FOR INTERNAL COMBUSTION ENGINE

[75] Inventors: Lloyd H. Tuggle, Shreveport; Michael J. Ferlito, Bossier City, both of La.

[73] Assignee: Emerson Electric Co., St. Louis, Mo.

[21] Appl. No.: 502,474

[22] Filed: Jun. 9, 1983

[51] Int. Cl.[3] ..... F02N 17/00

[52] U.S. Cl. ..... 123/187.5 R; 417/555 R; 261/DIG. 73; 222/384

[58] Field of Search ..... 123/187.5 R, 187.5 P, 123/180 P; 417/489, 437, 555 R, 555 A; 261/DIG. 73; 222/340, 383, 384, 385

[56] References Cited

U.S. PATENT DOCUMENTS

| | | | |
|---|---|---|---|
| 1,009,185 | 11/1911 | Sargent | 123/187.5 R |
| 1,145,814 | 7/1915 | St. Clair | 123/187.5 R |
| 1,488,566 | 4/1924 | Stokes | 123/180 P |
| 1,572,381 | 2/1926 | Cowles | 123/180 P |
| 2,148,265 | 2/1939 | Goodman et al. | 123/187.5 R |
| 3,345,045 | 10/1967 | Tuggle | 261/34 |
| 3,620,202 | 11/1971 | Ross | 123/179 G |
| 3,805,758 | 4/1974 | May | 123/139 AJ |
| 3,987,775 | 10/1976 | O'Connor | 123/187.5 R |
| 4,301,826 | 11/1981 | Beckerer | 417/555 R |
| 4,309,968 | 1/1982 | DuBois | 123/187.5 R |
| 4,373,479 | 2/1983 | Billingsley et al. | 123/187.5 R |
| 4,375,206 | 5/1983 | Baltz et al. | 123/187.5 R |

FOREIGN PATENT DOCUMENTS

| | | | |
|---|---|---|---|
| 0438691 | 5/1912 | France | 123/187.5 R |
| 0164747 | 12/1980 | Japan | 123/187.5 R |

*Primary Examiner*—Parshotam S. Lall

*Attorney, Agent, or Firm*—Hubbard, Thurman, Turner & Tucker

[57] ABSTRACT

A fuel priming system for spark ignited internal combustion engines includes a manually actuated plunger pump for delivering liquid fuel from a tank to a reservoir chamber formed in part by a flexible diaphragm. A fuel injection passage leads from the reservoir chamber through a flow restricting orifice to an injection point formed in the engine intake air flow passage downstream of the carburetor venturi. The injection system provides for enriching the fuel-air mixture during cold starting while minimizing the chance of engine flooding. The finite fuel volume in the reservoir chamber also provides a sufficient quantity of fuel for automatic control of a rich fuel-air mixture during engine warm-up.

46 Claims, 8 Drawing Figures

FUEL MIXTURE ENRICHMENT SYSTEM FOR INTERNAL COMBUSTION ENGINE

BACKGROUND OF THE INVENTION

1. Field of the Invention

The present invention pertains to a fuel mixture enrichment system particularly adapted for starting manually cranked two stroke cycle internal combustion engines wherein a predetermined quantity of liquid fuel is injected into the engine intake air flow stream during engine starting.

2. Background

In the art of internal combustion engines of the type wherein fuel is premixed with engine intake air in a carburetor or throttle body various systems have been developed for enriching the fuel-air mixture to enable the engine to start and run during a warm-up period. The conventional method of enriching the fuel-air mixture in both four stroke cycle and two stroke cycle engines includes a choke or secondary throttling valve which is held substantially closed during engine starting to restrict air flow and promote increased liquid fuel flow into the engine inlet air flow stream to provide a relatively rich fuel-air mixture.

However, conventional air flow throttling choke mechanisms as well as other known types of priming or mixture enriching devices have certain disadvantages and do not function well with carburetors for lightweight two stroke cycle type engines, particularly carburetors of the type that are adapted for use in a variety of engine directional attitudes. Small two stroke cycle engines are widely used on hand held power tools used by persons generally unfamiliar with internal combustion engine manual starting techniques. These engines are adapted for use in a variety of directional attitudes and they typically utilize a carburetor of the so called diaphragm type wherein a relatively small reservoir of fuel is maintained in the carburetor body for metering through the idle and high speed orifices or jets. The lack of fuel in the carburetor of the type of engine described above after a period of disuse makes these engines particularly difficult to start utilizing conventional air throttling type choke mechanisms. On the other hand starting of most two and four stroke cycle engines utilizing conventional choke devices can also be difficult in respect to the fact that if the choke is left closed through too many cranking cycles without an engine start, the engine may become flooded and continue to flood to a point where starting is hopeless until the engine has been left idle long enough to allow the excess fuel in the crankcase and/or the combustion chamber to evaporate and a proper fuel-air mixture to be restored. Manually operated chokes are also cumbersome to operate for inexperienced persons and must be constantly and quickly adjusted once an engine start is achieved to prevent flooding and thereby stalling the engine.

Although certain types of mixture enriching or priming systems other than chokes have been developed for carbureted engines and other types of engines having fuel-air mixing before introduction into the combustion chamber, known systems have not been successful for a variety of reasons. One problem associated with known types of priming systems pertains to the lack of mechanism for injecting consistently precise measured quantities of fuel to avoid flooding the engine. Accordingly, the number of priming strokes during engine start and warm-up operation cannot be easily determined or controlled. Moreover, known systems are generally adapted for use with engines having float bowl type carburetors as opposed to engines with diaphragm type carburetors or fuel injection systems. Another disadvantage of known types of priming systems used in conjunction with conventional downdraft or sidedraft carburetors is that, if the engine fails to start after one or two starting cycles, the mixture present in the engine intake system and combustion chamber usually becomes richer, if priming is continued, to the point of flooding the engine.

Yet another starting problem occurs when an engine has run out of fuel and wherein the engine must be cranked through several starting cycles just to pump fuel from the engine fuel tank to the carburetor. This problem is particularly acute with small engines with so called diaphragm type carburetors or with priming systems, including chokes, which rely on fuel at the carburetor to provide the rich mixture required for starting. All of the abovementioned engine starting problems are, of course, aggravated when the engine is in the hands of an inexperienced user. However, the problems associated with prior art types of fuel priming systems have been overcome with the mixture enriching system of the present invention.

SUMMARY OF THE INVENTION

The present invention provides an improved priming or fuel supply system for starting internal combustion engines wherein a relatively precise predetermined quantity of fuel may be injected into the engine intake air flow stream to provide a properly rich fuel-air mixture for engine starting and warm-up.

In accordance with one aspect of the present invention there is provided a fuel-air mixture enriching system utilizing a manually operated plunger pump which is interposed in a fuel flow line leading from an engine fuel tank to a reservoir chamber having a flexible diaphragm type movable wall which provides for storing and discharging a predetermined quantity of fuel into the engine fuel-air intake system during an engine starting and warm-up period. The reservoir chamber is preferably adapted to conduct fuel through a conduit including a flow restricting orifice for injection of liquid fuel into an intake manifold portion of the engine downstream of the carburetor venturi and carburetor throttling valve.

The priming system, including the reservoir chamber, is adapted to limit the amount of fuel that is injected into the air flow stream during a starting cycle, dependent on the number of strokes of the manually operated plunger pump. When a prescribed number of pump strokes have been performed by the engine operator, the reservoir chamber is filled with a predetermined quantity of fuel, and an excess quantity over that which may be stored in the chamber is injected into the engine intake manifold to wet the walls of the fuel-air flow passage to provide an initial rich mixture for causing the engine to fire. Upon initial starting of the engine the pressure in the fuel-air intake flow passage at the manifold is reduced sufficiently to cause the movable wall of the reservoir chamber to discharge the quantity of fuel in the chamber into the engine fuel-air flow stream at a rate determined by the flow restricting orifice to provide a rich mixture during an engine warm-up period and until the carburetor becomes operable to inject fuel into the engine intake system. The arrangement of the plunger pump and reservoir chamber provides for the injection of only a limited quantity of fuel into the engine when the pump is stroked through a requisite number of pumping cycles to thereby minimize the chance of flooding the engine during a start.

In accordance with another aspect of the present invention there is provided an improved fuel priming system for starting an internal combustion engine wherein the engine is provided with an updraft carburetor and the priming system is adapted to inject a quantity of fuel into the engine fuel-air mixture intake system at a point wherein excess fuel will tend to drain out of the carburetor through the carburetor venturi to minimize the chance of flooding the engine in the event that an excessive amount of fuel is injected through the priming system. Accordingly, if the engine tends to be flooded continued cranking of the engine without injection of priming fuel will quickly restore a leaner mixture required for starting the engine. The priming system is active in that continued stroking of a priming pump must occur to inject fuel prior to an initial engine start. Therefore, the operator cannot overlook a condition which will flood the engine such as often occurs with manual chokes.

The fuel mixture enriching system of the present invention holds several advantages over prior art systems. The priming or mixture enriching system operates independently of the carburetor fuel system and, accordingly, is operable to provide fuel for starting an engine whose carburetor fuel system has previously run dry or has not been charged such as with a new engine just placed in service. The independent fuel flow circuit between the engine fuel tank and the engine intake manifold is particularly advantageous for engines utilizing carburetors of a type which usually have a very limited amount of fuel or no fuel present at the carburetor prior to engine starting. In this respect, the present invention is particularly useful for lightweight two stroke cycle engines equipped with diaphragm type carburetors, although the system is not necessarily limited to exclusive use with engines of this specific type.

The fuel mixture enriching system is arranged such that fuel is always present at the inlet to a manually actuated plunger pump as long as there is a quantity of fuel in the engine fuel tank. The system also tends to be friendly to the user in that, with a prescribed number of actuating strokes of the plunger pump, if the engine fires and dies it indicates to the user that the mixture is lean. On the other hand, if an excessive number of strokes of the plunger pump are attempted fuel will not accumulate in the engine intake flow passages to flood the engine and make it more difficult to start. The plunger pump is of a unique design which will prevent unrestricted flow of fuel out of the engine fuel tank and through the mixture enrichment system.

Moreover, the present invention is also adapted for use with a hand held engine power unit wherein the manually actuated priming pump is located such that an operator handling the power unit may operate the pump without releasing his grip on the engine throttle lever or a carrying handle for the power unit. The plunger pump may be conveniently stroked by the operator if the engine should indicate a lean mixture during the starting cycle without requiring the shifting or removing of the operator's hand from the engine carrying handle. Furthermore, the manually actuated priming pump also allows the operator to easily adjust for ambient temperature conditions by using more or less pump strokes during the priming phase. The system is mechanically uncomplicated and easy to operate by personnel inexperienced with the operating characteristics of small manual starting type engines, in particular.

Those skilled in the art of internal combustion engine fuel supply systems will recognize the abovedescribed features and advantages of the present invention as well as other superior aspects thereof upon reading the detailed description which follows in conjunction with the drawings.

DESCRIPTION OF THE PREFERRED EMBODIMENT

Figure 1:
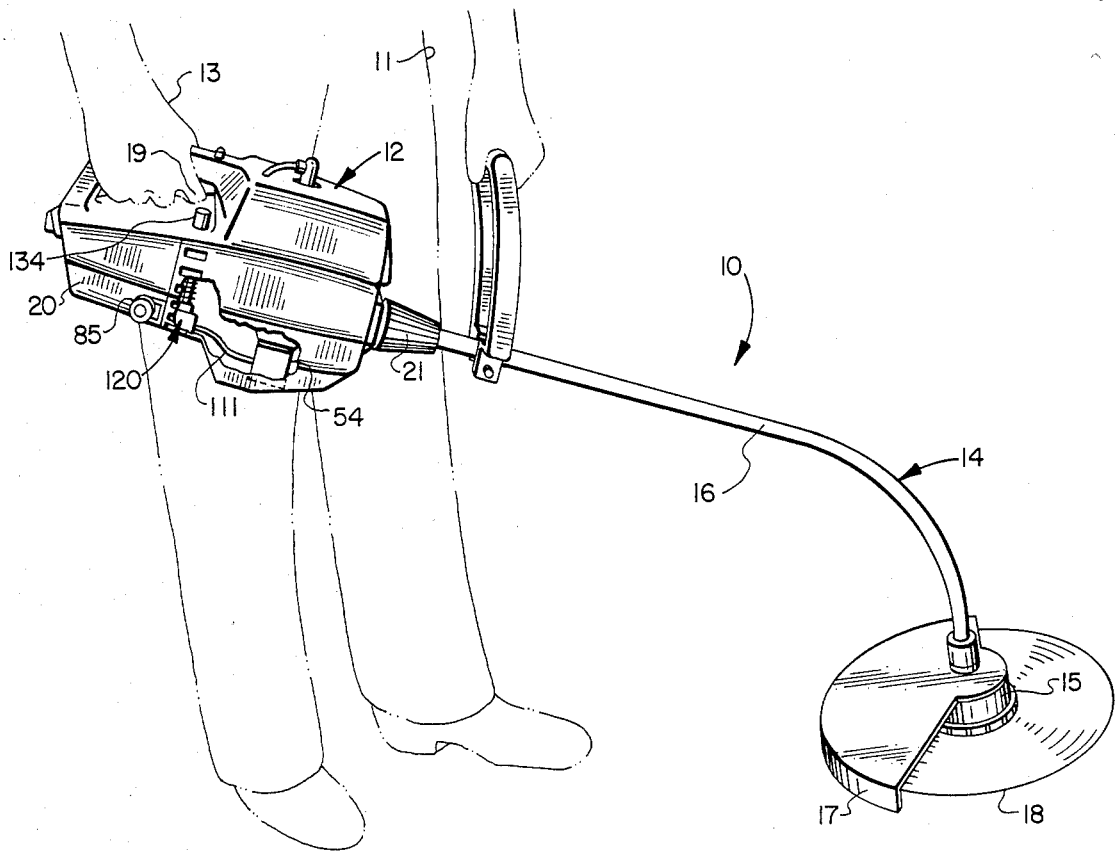
FIG. 1 is a perspective view of a hand held power tool driven by a lightweight internal combustion engine power unit utilizing the fuel-air mixture enriching system of the present invention.

In the description which follows like parts are marked throughout the specification and drawings with the same reference numerals, respectively. The drawings are not necessarily to scale and certain features of the invention may be shown exaggerated in scale or in somewhat schematic form in the interest of clarity and conciseness.

Referring to FIG. 1, there is illustrated a portable internal combustion engine driven power tool, generally designated by the numeral 10. The power tool 10 comprises an internal combustion engine power unit 12 which is adapted to be connected to a variety of attachments including a weed or grass trimming unit 14. The grass trimming unit 14 is characterized by a head 15 having a rotatable member, not shown, which is connected to a flexible drive shaft extending through a supporting shaft or tube 16 suitably coupled to the engine unit 12. The head 15 may include a flexible nonmetallic line extending therefrom and rotatable to define a cutting plane 18. The head also includes a protective cutting line guard 17. The head 15 may also be adapted to rotatably support a substantially rigid circular blade, not shown. The engine unit 12 may be adapted to be connected to a variety of power tool attachments by way of a coupling 21 in accordance with the description in U.S. Pat. No. 4,286,675 to Lloyd H. Tuggle and which is assigned to the assignee of the present invention.

Figure 2:
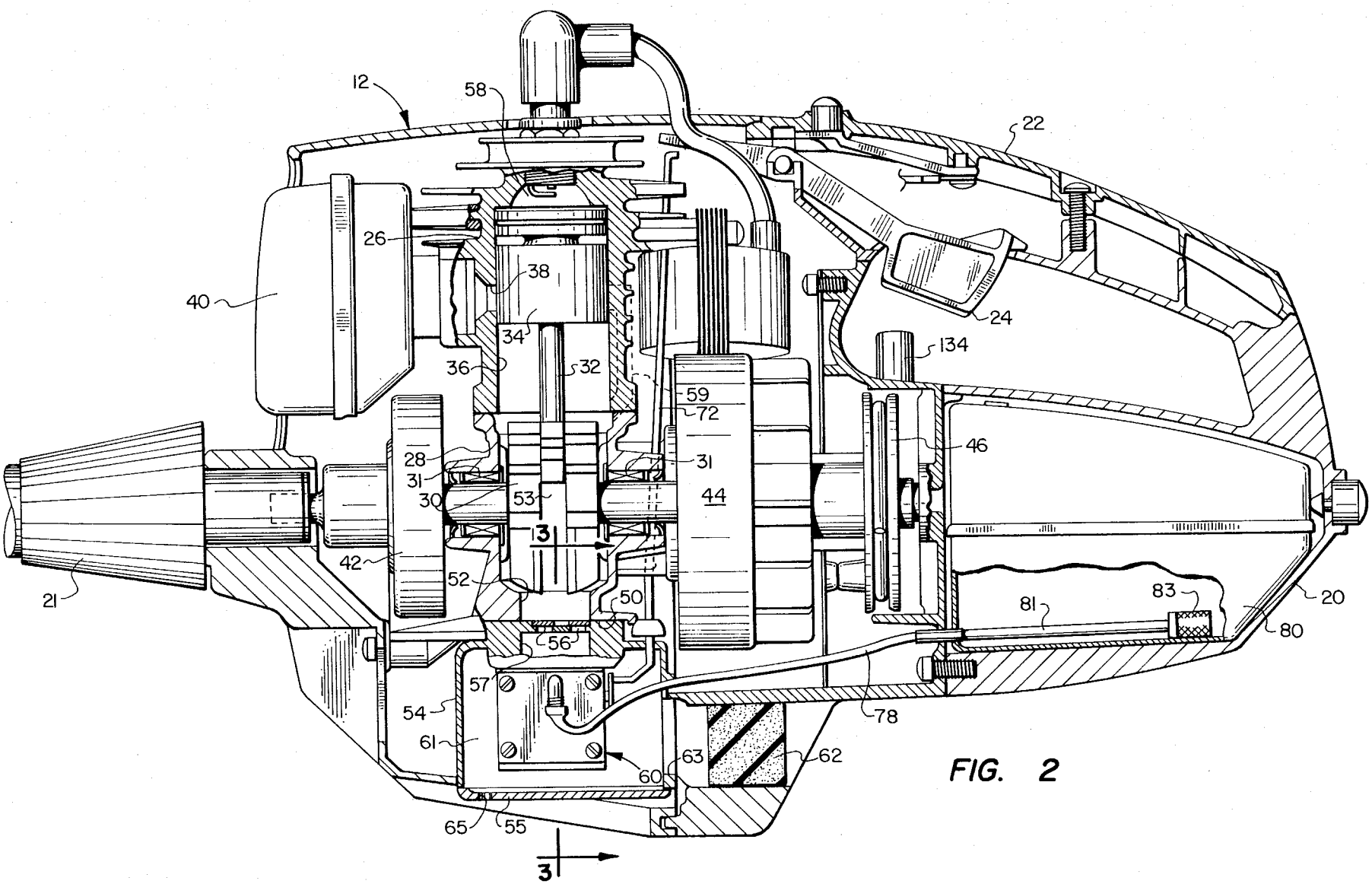
FIG. 2 is a longitudinal side elevation, partially sectioned, of the power unit illustrated in FIG. 1.

The engine unit 12 is similar in some respects to the engine unit described and claimed in the above referenced patent. Referring also to FIG. 2, the engine unit 12 includes a casing 20 having a longitudinally extending handle portion 22 and an engine throttle lever 24 adapted to be digitally actuated to control engine speed. The casing 20 is adapted to support a two stroke cycle, spark ignited, single cylinder engine including a finned cylinder block 26, a crankcase 28, and a single throw counterweighted crankshaft 30. The crankshaft 30 is rotatably supported in suitable bearings 31 in the crankcase 28 and is connected by a conventional piston rod 32 to a piston 34 reciprocable in a cylinder bore 36. The cylinder 26 includes an exhaust port 38 opening into a muffler assembly 40.

Figure 4:
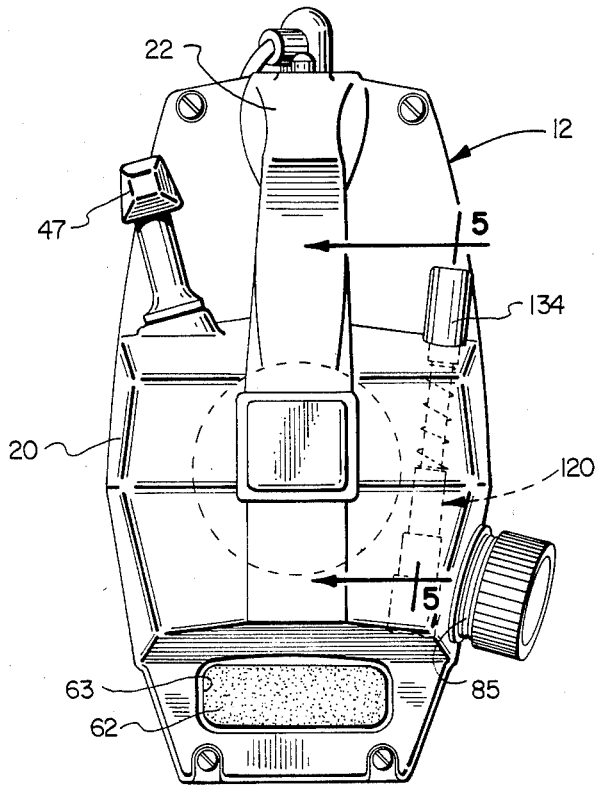
FIG. 4 is a rear end view of the power unit.

The crankshaft 30 is adapted to be drivably connected to a centrifugal clutch and power takeoff assembly 42 drivably connected to one of several power tool attachments such as the weed and grass trimming unit 14. The opposite end of the crankshaft 30 is suitably connected to a flywheel assembly 44 and to a conventional automatic rewinding manual rope pull type starter 46. The starter 46 is of conventional construction and includes a rewinding rope having a handle 47, FIG. 4. The starter 46 may be replaced by an electric starter, not shown, suitably drivably engageable with the crankshaft 30 for cranking the engine. Other types of starters may be used also. Certain other details of the engine unit 12 which are considered to be unimportant to an understanding of the present invention may, however, be further appreciated by reference to U.S. Pat. No. 4,286,675.

Figure 3:
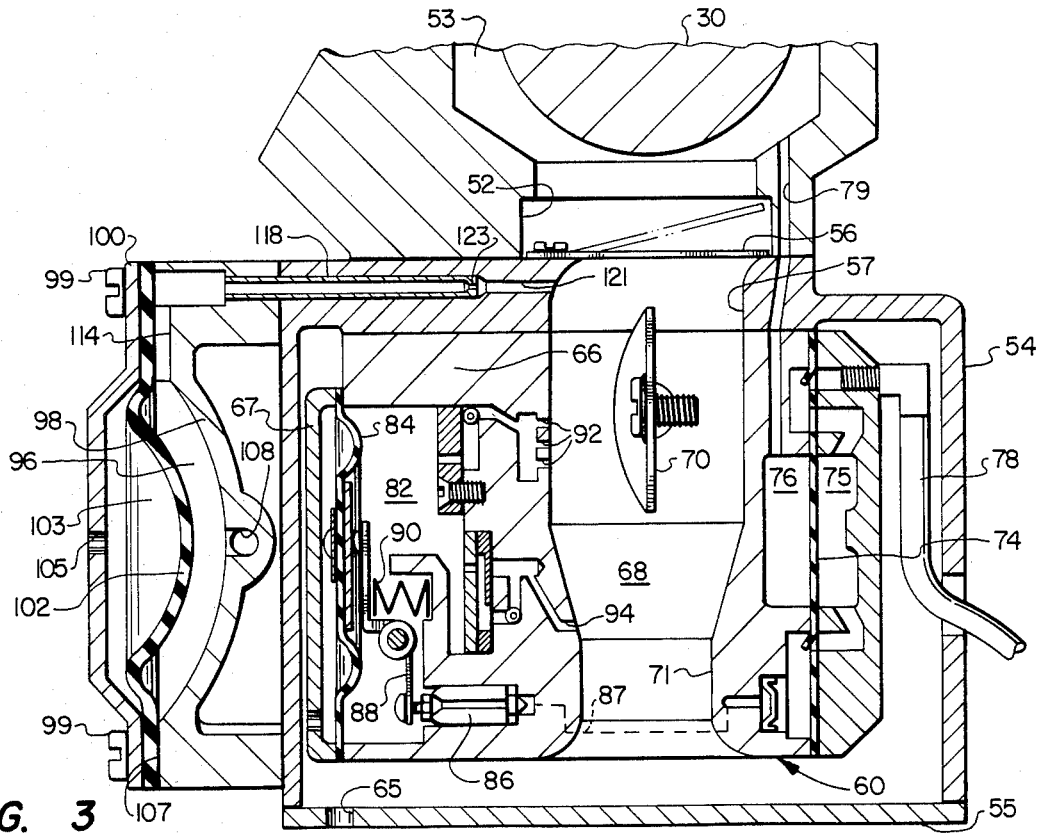
FIG. 3 is a section view taken along the line 3—3 of FIG. 2.

Referring to FIGS. 2 and 3, the engine unit 12 also includes a downwardly facing mounting face 50 formed on the crankcase 28. A fuel-air mixture intake passage 52 opens to the face 50 over which is fitted a housing 54 for supporting one or more reed type fuel-air mixture intake valve 56 interposed in a manifold passage 57. The housing 54 is adapted to enclose and support a carburetor 60, to form a heat shield for the carburetor and to provide for directing engine intake air flow to the carburetor from a preferred direction.

The engine described herein is of the type wherein flow of a fuel-air mixture is induced into an interior chamber 53 of the crankcase 28 and is transferred to a combustion chamber 58 by the pumping action of the piston 34 which causes the mixture in the chamber 53 to flow through a passage 59, indicated schematically in FIG. 2, into the combustion chamber. Suffice it to say that the fuel-air mixture is drawn into and through the passage 52 in a rapid pulse type action wherein the pressure in the crankcase interior chamber 53 alternately increases and decreases as the piston 34 reciprocates in the bore 36. This action is so rapid however, that even during a starting cycle a reduced pressure less than atmospheric pressure is present in the passage 57 and the chamber 53.

Referring further to FIG. 2, the carburetor 60 is suitably mounted on the housing 54 within an enclosure 61 formed by the housing and may be accessed through a removable cover member 55. Engine intake air is drawn into the enclosure 61 through an air filter 62 and an inlet passage 63 formed in a rear wall of the housing 54. The carburetor 60 is of the so called diaphragm type preferably used for internal combustion engines that are adapted to be operated in various directional attitudes and wherein it is necessary to provide a positive flow of fuel to the carburetor metering orifices or jets regardless of engine directional attitude. However, one disadvantage of a diaphragm type carburetor and certain other types of fuel-air mixing systems is that under certain circumstances there is not a sufficient reservoir of fuel in proximity to the fuel injection orifices or jets to provide for easy engine starting and warm-up using a conventional air throttling choke valve or a priming system which utilizes the carburetor reservoir.

The engine unit 12 is arranged such that, in its normal operating position as shown in FIG. 1, the carburetor 60 functions as an updraft carburetor, that is engine intake air flows through the carburetor generally vertically upward and excess fuel not entrained with intake air will drain out of the carburetor and the enclosure 61 by way of a passage 65, FIG. 2, in the cover 55 instead of into the engine air intake passages. This arrangement, in conjunction with the improved fuel mixture enriching system of the present invention, reduces the tendency of the engine to be flooded if an excess amount of primer fuel is injected during an engine starting effort.

Referring now to FIG. 3, in particular, the carburetor 60 is shown in vertical section view and includes a throttle body 66 having a main air flow passage or venturi 68 extending therethrough and in communication with the passage 57 and the crankcase fuel-air inlet passages 52–53 by way of the reed valves 56. The carburetor 60 includes a conventional butterfly type throttling valve 70 rotatably supported on the body 66 and connected to the throttle lever 24 by suitable linkage 72, FIG. 2. The throttling valve 70 is disposed in the venturi 68 downstream of a venturi throat portion 71 in a conventional manner. The body 66 also houses a diaphragm type fuel pump including a flexible diaphragm pumping element 74 which divides a cavity in the body 66 into opposed chambers 75 and 76. A main fuel supply line 78 is connected to the carburetor 60 and to a fuel source comprising a tank 80, FIG. 2, disposed in the engine casing 20 behind the starter assembly 46. A flexible suction line 81 extends into the tank 80 and includes a strainer element 83 attached thereto. The tank 80 is adapted to be filled through a capped filler neck 85, FIGS. 1 and 4.

The pump chamber 76 is in communication with the interior chamber or passage 53 of the crankcase 28 by way of a passage 79, FIG. 3, for displacing the diaphragm 74 to pump fuel from the tank 80 to a reservoir 82 in the carburetor body by way of a suitable passage 85. The reservoir 82 is delimited by a flexible diaphragm 84 which is connected to a needle valve 86 by a bellcrank type linkage 88. The linkage 88 is biased by a coil spring 90 to cause the needle valve 86 to close. However, as liquid fuel in the reservoir 82 is drawn into the venturi 68 through the carburetor metering jets, the diaphragm 84 moves away from wall 67 to unseat the needle valve and maintain a predetermined quantity of fuel in the reservoir. The reservoir 82 feeds fuel through idle and high speed orifices or jets 92 and 94, respectively, which are also controlled by conventional adjustable needle valves, not shown. The carburetor 60 is similar in some respects to a type made by Walbro Corporation, Cass City, Mich., as their model WA.

Figure 5:
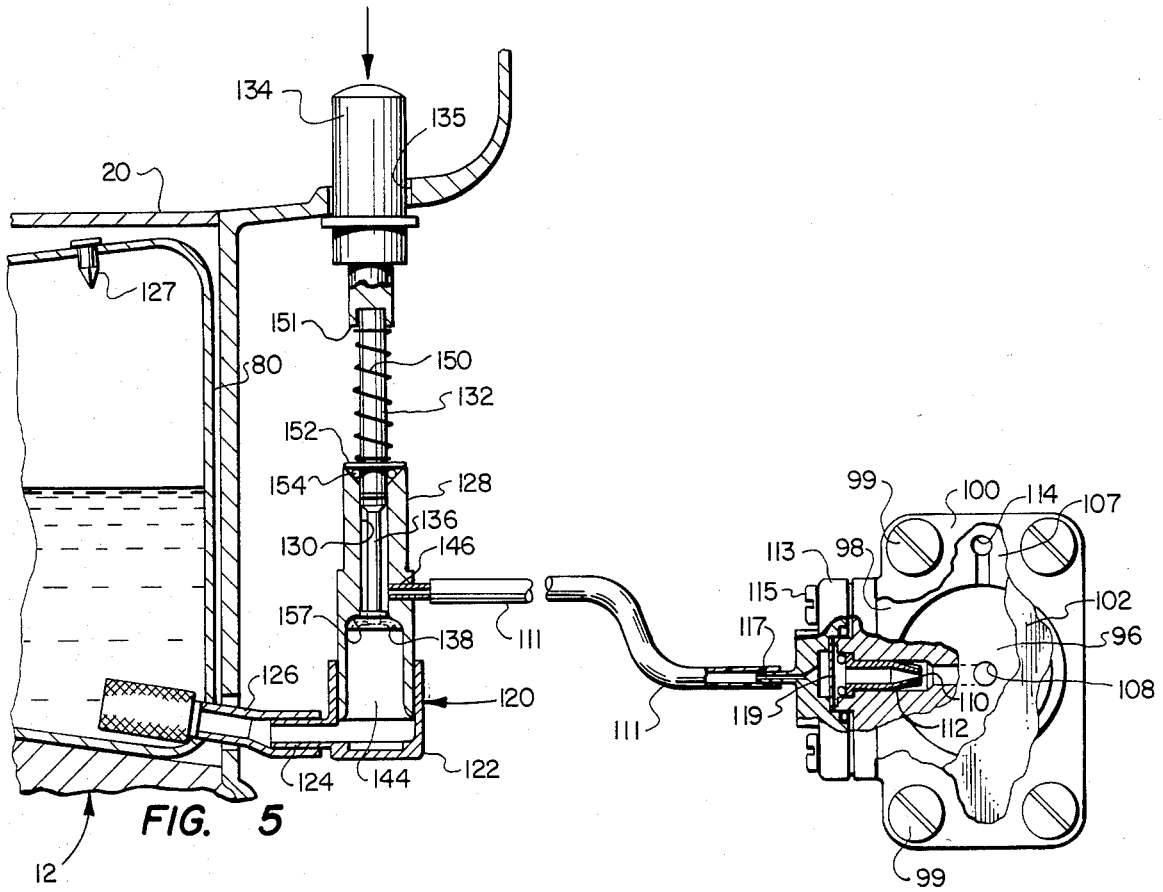
FIG. 5 is a detail view taken in part as a section view along the line 5—5 of FIG. 4 and showing the components of the fuel mixture enriching system.

Referring further to FIG. 3 and also FIG. 5, the fuel mixture enriching system of the present invention includes means comprising a fuel reservoir chamber 96 formed in part by a housing member 98 which is suitably mounted on a sidewall of the housing 54 by screws 99. The chamber 96 is also defined in part by movable wall means comprising a flexible diaphragm member 102 which is suitably clamped between a surface 107 on the housing member 98 and a removable cover member 100. The diaphragm 102 is also exposed to an expansion cavity 103 which is vented to atmosphere through a passage 105 in the cover member 100. The diaphragm 102 is preferably made of a flexible material such as neoprene but is not distendable. Other forms of movable wall means or chamber volume compensating or reducing means may be used to vary the effective volume of the reservoir chamber 96.

Referring particularly to FIG. 5, the reservoir chamber 96 is in communication with a passage 108 which opens into a cavity 110 having a one way valve 112 interposed therein. The valve 112 is preferably of the flexible closure member or so called duckbill type which will function as a check valve to prevent fuel flow out of the chamber 96 by way of passage 108. The valve 112 is suitably retained in the cavity 110 and is accessible by a removable cover member 113 secured to the housing member 98 by fasteners 115. The cover member 113 includes a passage formed in a spigot type fuel line connector 117 and a filter screen 119 is disposed upstream of the valve 112. The chamber 96 is also in communication with a fuel discharge conduit portion 114 formed in the housing member 98 and which is in communication with a passage 121 in the housing 54, FIG. 3, opening into the passage 57 downstream of the throttle valve 70. The term downstream as used herein refers to the normal direction of air flow through the venturi 68 when the engine is operating. The passage 121 is provided with a flow restricting orifice 123 which is preferably formed in an elongated tube fitting 118 pressed into a bore formed in the housing member 98 and adapted to be slidably inserted into an enlarged bore portion of passage 121, as illustrated.

The chamber 96 is supplied with fuel by way of a flexible conduit 111 connected to the connector 117 and to a manually operable plunger pump 120, FIG. 5, which is in communication with the fuel tank 80. The plunger pump 120 includes a base or body member 122 forming an inlet fitting 124 which is adapted to be connected to a substantially rigid conduit 126 extending through the wall of the tank 80 for receiving fuel directly from the lower front portion of the tank interior. The tank 80 is suitably vented to permit air to flow into the tank interior by way of a one way valve 127 similar to the valve 112. The pump body 122 includes a plunger support portion 128 suitably fixed to the member 122 and formed with an elongated bore 130 for receiving a reciprocable plunger rod 132. The rod 132 extends upward through bore 130 and is connected to an actuator member 134 which projects through an opening 135 in the casing 20 in proximity to the index finger of the right hand of a person holding the handle 22 as indicated in FIG. 1. The actuator member 134 is suitably secured to the rod 132 and is provided with an integral collar, as shown in FIG. 5.

Figure 6:
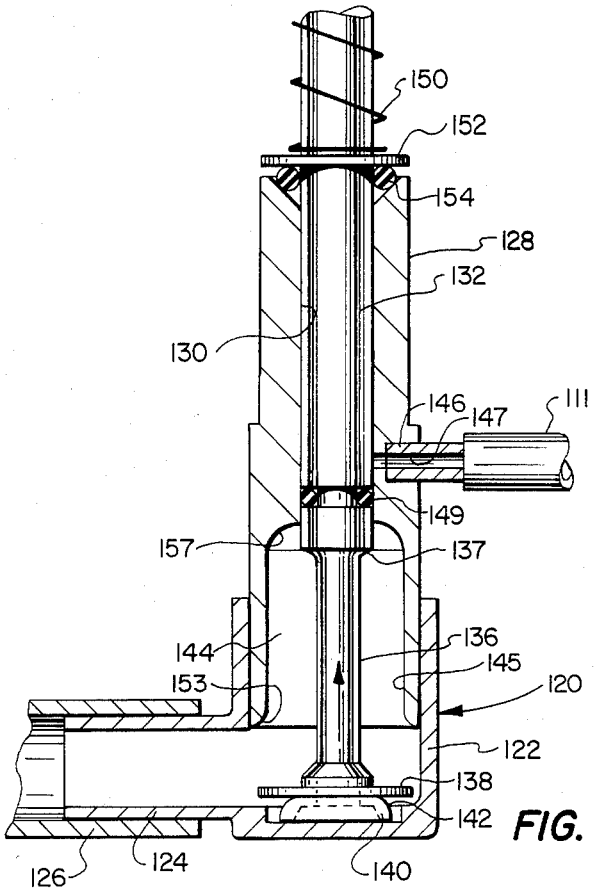
FIG. 6 is a detail section view of the manual plunger pump with the plunger fully depressed to allow a charge of fuel to enter the pump chamber.
Figure 7:
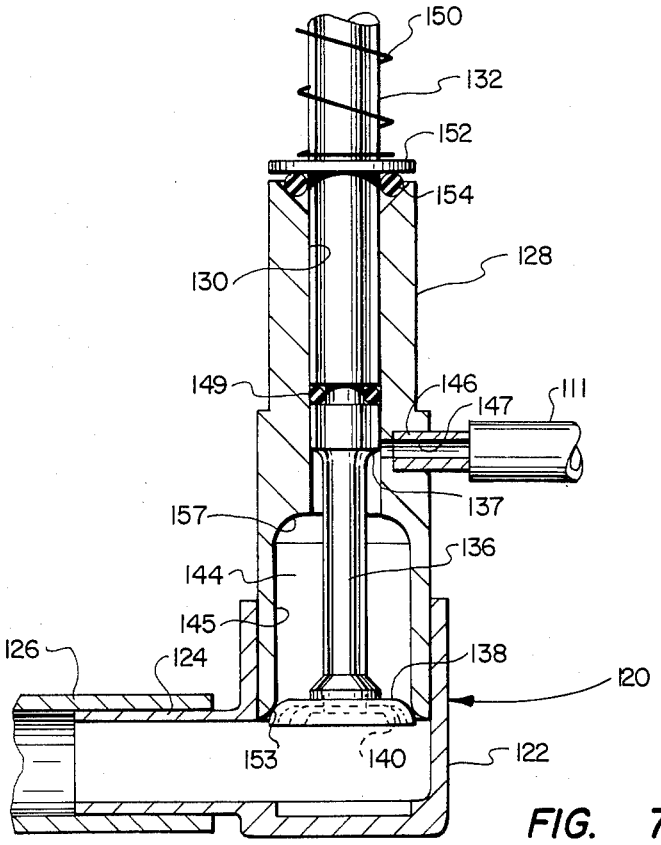
FIG. 7 is a view similar to FIG. 6 showing the pump in a position to commence delivery of a charge of fuel.
Figure 8:
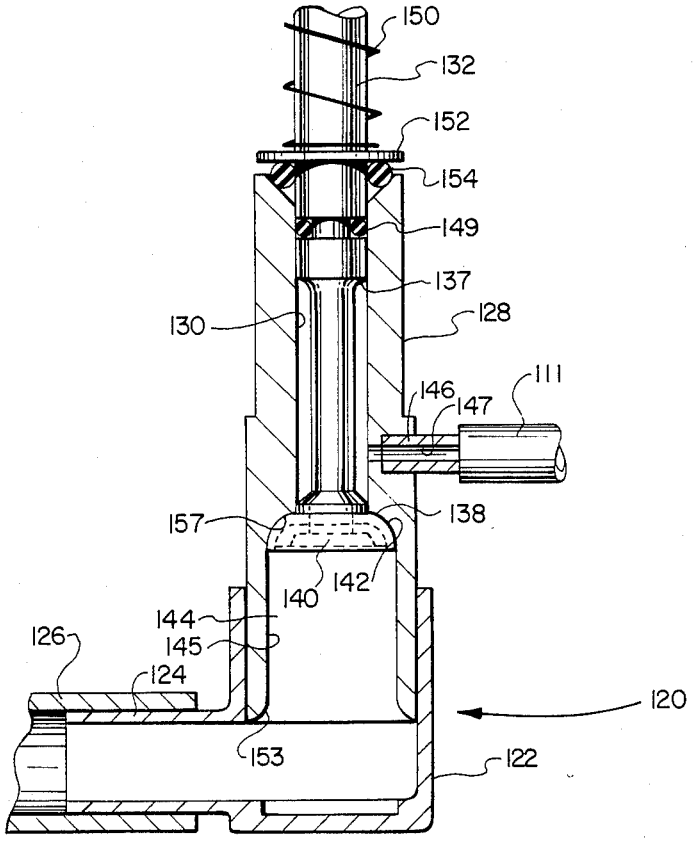
FIG. 8 is a view similar to FIGS. 6 and 7 showing the pump plunger fully retracted at the end of a charge delivery stroke.

Referring also to FIGS. 6, 7 and 8, the plunger rod 132 is provided with an o-ring seal 149 adapted to be in slidable sealing engagement with the bore 130. The rod 132 also includes a reduced diameter portion 136 forming a transverse shoulder 137 below the o-ring 149. The distal end of the rod portion 136 supports a cylindrical resilient plunger member 138. The plunger 138 is backed by a strain relief and support member 140 having a convex curved wall 142, FIG. 6. The plunger 138 of the pump 120 is normally biased into a position to discharge fuel from an interior chamber 144 formed within the body member 122 and the plunger rod support portion 128.

In the position of the plunger rod 132 illustrated in FIGS. 5 and 8, the plunger 138 has completed a stroke to discharge fuel from the chamber 144 through a spigot type connector or fitting 146 which includes a passage 147 formed therein and in the body 128 and opening into the bore 130. The fitting 146 is connected to the flexible fuel conduit 111. The plunger rod 132 is biased in the position shown in FIGS. 5 and 8 by a coil spring 150 disposed around the rod 132 and bearing against suitable means such as a transverse shoulder 151 formed on the actuator 134. The opposite end of the spring 150 bears against a washer 152 which in turn bears against a resilient o-ring seal member 154 disposed in a cavity in the rod support portion 128.

In the position of the plunger rod 132 illustrated in FIG. 8, the resilient plunger 138 is sealingly engaged with a curved end wall 157 of the chamber 144 to prevent fuel from flowing freely from the tank 80 to the conduit 111. As the actuator 134 is depressed to push the plunger rod 132 downwardly, viewing FIGS. 6, 7 and 8, the plunger 138 will move out of sealing engagement with the bore wall 145 formed by the body member 128 to permit fuel to flow into the chamber 144 above the plunger. At the point at which the plunger 138 breaks sealing engagement with the bore wall 145 at a curved control edge 153, FIG. 7, the passage formed between the reduced diameter rod portion 136 and the bore 130 is substantially closed from communication with the passage 147 at the shoulder 137 so that fuel may not flow directly from the tank 80 to the conduit 111. Normally, actuation of the plunger rod 132 in the downward direction will move the o-ring 149 past the edge of passage 147 rather quickly to positively seal off communication between the chamber 144 and passage 147. This is particularly important since the tank 80 may be under pressure from thermal expansion of fuel in the tank prior to starting the engine. Without precise control of the priming fuel injected through the mixture enrichment system, as provided by the improved pump 120 as well as the reservoir chamber 96, excess fuel can flow into the passage 57. If there is a pressure drop across the plunger 138 between the tank 80 and the chamber 144 at the point at which the plunger breaks sealing engagement with the control edge 153 the resilient plunger will tend to remain engaged with the bore wall 145 until o-ring 149 has moved well past the passage 147 to seal off communication between the tank 80 and the conduit 111.

During the downward stroke of the plunger 138, the pressure in the passageways formed by the fitting 146, the conduit 111 and the ever increasing volume of the chamber 144 is reduced since fuel may not flow reversely through the conduit 111, thanks to the provision of the check valve 112. Accordingly, at the time that the plunger 138 moves out of sealing engagement with the bore wall 145 at the control edge 153 a sufficient reduction in pressure is definitely present in the chamber 144 to provide for charging the chamber completely with a quantity of fuel from the tank 80.

When the plunger actuator 134 is released, the spring 150 will bias the rod 132 upwardly to stroke the plunger 138 from the position shown in FIG. 6 back to the position shown in FIG. 7, whereupon the plunger 138 will again sealingly engage the bore wall 145 to trap a predetermined quantity of fuel in the chamber 144. At this point, the o-ring seal 149 will move clear of the passage 147 so that, as the plunger 138 moves upwardly from the position of FIG. 7 to the position of FIG. 8, a predetermined quantity of fuel will be discharged into and through the conduit 111 to the reservoir chamber 96. If excess pressure is present in the system downstream of the pump 120, such as might be caused by blockage of the flow restricting orifice 123 in the tube 118 FIG. 3, the plunger 138 may be deflected sufficiently to permit bypass of fuel out of the chamber 144 to the opposite side of the plunger. The pump 120 also automatically limits the flow rate of fuel due to the combination of the orifice 123 and the flow restriction throughout the injection system as balanced or overcome by the bias of the spring 150. In this way, the rate of injection of fuel and the quantity of fuel injected by the priming system is independent of operator handling or use characteristics since the pump 120 is operable to deliver fuel only upon release of the plunger actuator 134 and under the urging of the spring 150.

The displacement of the pump 120 may be predetermined so that a relatively few number of plunger strokes will be sufficient to fill the reservoir chamber 96 and to provide an initial charge of a predetermined quantity of fuel into the passage 57. For example, the displacement of the pump 120 is preferably determined to be such that two strokes of the plunger 138 will fill the chamber 96 displacing the diaphragm 102 to its limit position. A third stroke of the pump plunger 138 will result in forcing a charge of fuel substantially equal to pump displacement through the system, including the reservoir chamber 96 and the discharge conduit or passage means 114, 121, into the engine air intake passage 57 to wet the walls defining the passage 57 as well as the carburetor venturi 68.

Thanks to the position of the pump 120 relative to the tank 80, in a normal operating attitude of the engine unit 12, a positive low pressure head of fuel is always present at the chamber 144 as long as a quantity of fuel is present in the tank. The proximity of the pump 120 to the tank 80 minimizes the restriction of fuel flow directly into the pump chamber 144 and a relatively small diameter flow line or conduit 111 may be utilized between the pump and the reservoir chamber 96 in order to minimize the number of plunger strokes required to fill the chamber. The valve 112, of course, substantially prevents backflow of fuel into the chamber 144 when the pump plunger 138 is moved through a suction stroke. Moreover, when the pump plunger 138 is released it is always biased against the end wall 157 as shown in FIGS. 5 and 8 to prevent uncontrolled flow of fuel to the chamber 96 from the tank 80.

A typical operating sequence for starting the engine unit 12 when it is "cold" is to hold the engine in the substantially upright position, as shown in FIG. 1, with the carburetor 60 extending downwardly so that any excess fuel flowing into the passage 57 and the venturi 68 will flow out of the throat 71 and drain through the passage 65. If the fuel tank 80 is at least partially filled, the prescribed number of strokes of the plunger 138 will be sufficient to fill the chamber 96 and force an initial charge through the conduit or passage means 114–118–121 into the passage 57 to wet the passage walls including a portion of the venturi 68. After stroking the pump 120 the requisite number of times the engine is cranked by the automatic rewind starter 46 or other suitable starting means to draw a fuel-air mixture into the crankcase passage 52–53 by way of the reed valves 56.

The charge of fuel injected into the passage 57 is normally sufficient to cause the engine to start whereby the air pressure in the passage 57 at the point where the passage 121 opens into the passage 57 will be sufficiently reduced to draw substantially the entire quantity of fuel in the chamber 96 into the engine intake air flow stream at a metered rate determined by the orifice 123 to provide a relatively rich fuel-air mixture during engine warm-up. The rate of fuel flow is controlled by the orifice 123 to prevent the mixture from being too rich or too lean. The size of the orifice 123 and the maximum volume of the chamber 96 may be predetermined to be sufficient to provide a predetermined quantity of fuel and a flow rate which will allow a relatively rich fuel-air mixture to flow into the engine until the carburetor 60 begins to supply fuel to the venturi 68 and the engine reaches a suitable operating temperature that will permit it to continue to run under idle or under load with fuel supplied through the carburetor jets 92 and/or 94, only. Accordingly, the fuel priming or mixture enriching system described herein functions to some extent as an automatic choke but introduces a predetermined quantity of fuel into the engine to provide a rich fuel-air mixture only during the time required such as on starting a cold engine.

As previously mentioned, the fuel-air mixture enriching system described herein decreases the possibility of flooding the engine due to the arrangement of the carburetor 60 and the fact that, absent continued stroking of the pump 120, further cranking of the engine will not draw more than a predetermined quantity of fuel, i.e., primarily that which is in the chamber 96, into the fuel-air mixture flowing through the carburetor 60. This is in contrast with conventional throttling valve type chokes or certain other fuel mixture enriching devices which will result in ever increasing amounts of fuel to be drawn into the engine during the cranking operation or starting cycle.

Moreover, the location of the plunger operating member 134 facilitates operation of the fuel mixture enriching system with relative ease and once the engine starts there is no requirement to manually reset or open a choke device. Accordingly, an operator 11, see FIG. 1, of the engine unit 12 does not have to remove his hand 13 from the handle 22 during the starting cycle and, if the engine should indicate that it is running too lean, additional priming strokes may be conveniently obtained by actuation of the pump plunger actuator 134 with the index finger 19, for example. Of course, the number of plunger strokes required may also be easily adjusted in accordance with temperature and fuel combustibility conditions as well as the temperament of the particular engine, once the operator has familiarized himself with the engine operating characteristics.

Although the fuel priming or mixture enriching system described herein may be modified to inject fuel into the crankcase interior chamber 53 directly or into passage 59, for example, it is preferred to inject the priming fuel into the passage 57 so that better fuel-air mixing is accomplished and engine flooding is alleviated. Moreover, the mixture enriching system is not limited to use with diaphragm type carburetors or any specific type of carburetor. The system of the present invention may also be used with throttle body fuel injection systems as well as other air breathing engines.

A preferred embodiment of the invention has been described in detail herein; however, those skilled in the art will recognize that various substitutions and modifications may be made to the fuel-air mixture enriching and engine starting system of the present invention without departing from the scope and spirit of the invention recited in the appended claims.

What we claim is:

1. A fuel-air mixture enriching system for starting an internal combustion engine, said engine including a carburetor having air flow passage means therein, and a throttle valve disposed for throttling air flow through said carburetor, and further passage means interconnecting said carburetor air flow passage means with a combustion chamber of said engine, a source of liquid fuel, and means interconnecting said fuel source with said carburetor, said mixture enriching system comprising:

means forming a reservoir chamber having a predetermined volume in communication between said fuel source and one of said plurality of passage means, pump means for delivering fuel to said reservoir chamber prior to cranking of the engine, and conduit means for conducting fuel from said reservoir chamber into said one passage means responsive to a lower pressure developed in said air passage means by reciprocation of the piston to provide an enriched fuel-air mixture for induction into said combustion chamber during a starting cycle of said engine.

2. The system set forth in claim 1 wherein:

said reservoir chamber is formed in part by means operable to reduce the effective volume of said reservoir chamber as fuel flows from said reservoir chamber to said one passage means.

3. The system set forth in claim 1 wherein the pump means delivers a predetermined charge of fuel to said reservoir chamber during each manual stroke.

4. The system set forth in claim 3 wherein:

said pump includes means operable during actuation of said pump to prevent flow of fuel directly from said fuel source through said pump to said one passage means.

5. The system set forth in claim 3 wherein:

said pump means comprises a manually actuated plunger pump including plunger means reciprocably disposed in pump body means, said plunger means being actuatable by an operator of said engine to deliver a predetermined quantity of fuel to said reservoir chamber and to said one passage means dependent on the actuation of said plunger means.

6. The system set forth in claim 5 wherein:

said plunger means comprises a flexible cylindrical plunger operable to sealingly engage a bore wall of said body means to prevent flow of fuel under pressure from said fuel source to said reservoir chamber in a normally biased position of said plunger means and to bypass fuel under excess pressure during a discharge stroke of said plunger means.

7. The system set forth in claim 5 wherein:

said plunger pump includes means for urging said pump through a fuel delivery stroke upon release of said plunger by an operator of said pump whereby the rate of fuel flow to said one passage means is controlled independent of operator actuation of said pump.

8. The system set forth in claim 1 including:

one way valve means interposed in conduit means between said fuel source and said reservoir chamber to prevent reverse flow of fuel toward said fuel source from said reservoir chamber.

9. The system set forth in claim 1 wherein:

said conduit means is in communication with said one passage means between a throat of a venturi comprising said carburetor passage means and one way valve means in said passage means between said carburetor and said combustion chamber, said one way valve means opening into further passage means leading to said combustion chamber.

10. The system set forth in claim 1 including:

orifice means interposed in said conduit means between said reservoir chamber and said one passage means for metering the flow rate of fuel to said one passage means from said reservoir chamber to provide a relatively rich fuel-air mixture during engine warm-up.

11. The system set forth in claim 1 wherein:

said carburetor is arranged as an updraft type and said conduit means opens into said one passage means at a point such that excess fuel injected into said one passage means from said reservoir chamber will drain out of said carburetor through said carburetor air flow passage means.

12. The system set forth in claim 1 including:

a housing including said means forming said reservoir chamber, and means forming an enclosure for said carburetor, a portion of said passage means being formed in said housing between said carburetor air flow passage means and a crankcase chamber of said engine, said crankcase chamber forming a part of said passage means, said conduit means opening into said portion of said passage means in said housing.

13. A fuel-air mixture enriching system for an internal combustion engine, said engine including cylinder means including a combustion chamber, rotatable crankshaft means, means for rotating said crankshaft means to start said engine, and a throttle body including passage means in communication with further passage means in said engine for conducting a fuel-air mixture into said combustion chamber; said mixture enriching system including:

means forming a reservoir chamber for holding a predetermined quantity of liquid fuel;

conduit means in communication with one of said plurality of passage means and said reservoir chamber for conducting fuel to said one passage means;

a manually actuated pump for filling said reservoir chamber with a predetermined charge of fuel; and means for reducing the volume of said reservoir chamber for controlling the quantity of fuel injected into said one passage means in response to induction of fuel into said one passage means on starting said engine.

14. The system set forth in claim 13 wherein:

said means for reducing the volume of said reservoir chamber comprises movable wall means defining said reservoir chamber in part and operable to reduce the volume of said reservoir chamber to displace fuel from said reservoir chamber in response to a pressure drop in said reservoir chamber and said conduit means.

15. The system set forth in claim 14 wherein:

said movable wall means comprises a flexible diaphragm.

16. A fuel supply system for an internal combustion engine, said engine including throttle body means having air flow passage means therein, a throttle valve disposed for throttling air flow through said throttle body passage means, means forming further passage means interconnecting said throttle body passage means with a combustion chamber of said engine, and a source of liquid fuel; said fuel supply system comprising:

means forming a separate reservoir chamber in communication with said fuel source and one of said plurality of passage means, means for delivering a predetermined quantity of fuel to said one passage means through said reservoir chamber to prime said engine during a starting cycle, and means for controlling the flow of a predetermined quantity of fuel from said reservoir chamber into said one passage means to provide an enriched fuel-air mixture to said engine upon starting said engine.

17. The system set forth in claim 16 wherein:

said reservoir chamber includes movable wall means for urging said quantity of fuel in said reservoir chamber to be expelled into said passage means in response to a pressure differential across said movable wall means.

18. The system set forth in claim 16 wherein:

said flow controlling means comprises orifice means interposed in fuel carrying conduit means extending between said reservoir chamber and said one passage means.

19. The system set forth in claim 18 wherein:

said conduit means opens into passage means between said throttle body and passage means in a crankcase of said engine.

20. A portable internal combustion engine power unit for a power tool, said power unit including a spark ignited internal combustion engine including means defining a combustion chamber, a carburetor, passage means including a venturi in said carburetor in communication with said combustion chamber, said carburetor being oriented on said engine in a normal working position to place said venturi in an updraft configuration; and a fuel priming system for injecting a quantity of liquid fuel into said passage means including means forming a separate fuel reservoir chamber, conduit means interconnecting said reservoir chamber with a source of liquid fuel, and conduit means interconnecting said reservoir chamber with said passage means in said engine at a point which will permit excess fuel to drain out of said passage means in said normal working position of said engine to prevent entrainment of said fuel in air flowing to said combustion chamber, said priming system being operable in response to cranking said engine to induct fuel from said reservoir chamber into said passage means to substantially evacuate said reservoir chamber so that a predetermined limited quantity of fuel is inducted into said combustion chamber during an engine starting cycle.

21. The apparatus set forth in claim 20 wherein:

said means forming said reservoir chamber includes means operable to vary the volume of said reservoir chamber in response to charging and evacuating fuel with respect to said reservoir chamber.

22. The power unit set forth in claim 20 including:

a manually actuated pump on said power unit interposed in said conduit means between said fuel source and said reservoir chamber, said pump including body means forming a cylinder bore, plunger means disposed in said body means and operable to be moved through a suction stroke to induct a quantity of fuel into said cylinder bore, and means for moving said plunger means through a discharge stroke to deliver said quantity of fuel to said reservoir chamber.

23. The power unit set forth in claim 22 wherein:

said plunger means is cooperable with a surface in said cylinder bore to close off flow of fuel from said fuel source to said reservoir chamber, and said means for moving said plunger means is adapted to bias said plunger means in a position in said cylinder bore to engage said surface to close off flow of fuel through said pump from said fuel source to said reservoir chamber.

24. The power unit set forth in claim 20 wherein:

said pump includes a manual plunger actuator member disposed on said power unit in proximity to an operator handle of said power unit for actuation by the operator's hand which is grasping said handle to deliver a charge of fuel into said reservoir chamber during a starting cycle of said engine.

25. A portable internal combustion engine power unit for a power tool, said power unit including a spark ignited internal combustion engine including means defining a combustion chamber, a carburetor, fuel-air mixture flow passage means in communication with said carburetor and said combustion chamber, a fuel tank, and a fuel supply system for injecting a quantity of liquid fuel into said passage means, said fuel supply system including means forming a separate fuel reservoir chamber, first conduit means interconnecting said reservoir chamber with said fuel tank, and second conduit means interconnecting said reservoir chamber with said passage means, a manually actuated pump interposed in said first conduit means between said fuel tank and said reservoir chamber, said pump being operable at will to deliver a predetermined quantity of fuel to said passage means through said reservoir chamber to prime said engine for starting, said fuel supply system being responsive to starting said engine to conduct a predetermined quantity of fuel from said reservoir chamber into said passage means to provide a relatively rich fuel-air mixture to said combustion chamber during an engine warm-up period.

26. The power unit set forth in claim 25 wherein:

said pump includes a manual actuator member disposed on said power unit in proximity to an operator handle of said power unit for actuation by the operator's hand which is grasping said handle to deliver a charge of fuel to said reservoir chamber during a starting cycle of said engine without releasing said handle.

27. A fuel priming system for an internal combustion engine, said engine including means defining a combustion chamber, fuel-air mixture flow passage means in communication with said combustion chamber and a fuel tank, said fuel priming system including:

a manually actuated plunger pump interposed in conduit means between said tank and said passage means and being operable at will for delivering a predetermined quantity of fuel through said conduit means in response to manual actuation of plunger means, said pump including a main body portion including a bore for receiving said plunger means and defining a chamber through which said plunger means traverses to displace said predetermined quantity of fuel, and means operable to prevent unrestricted flow of fuel from said fuel tank and through said pump when said pump is actuated.

28. The fuel priming system set forth in claim 27 wherein:

said plunger means is engageable with a wall of said chamber to seal off flow of fuel from said fuel tank to said passage means.

29. The fuel priming system set forth in claim 27 wherein:

said pump includes a manual actuator connected to said plunger means to provide a suction stroke of said plunger means and means for urging said plunger means through a discharge stroke independent of operator actuation of said pump for delivering said predetermined quantity of fuel through said conduit means.

30. The fuel priming system set forth in claim 29 wherein:

said plunger means is deflectable to bypass fuel out of said chamber at a predetermined pressure in said chamber during a discharge stroke of said plunger means.

31. The fuel priming system set forth in claim 29 wherein:

said means for urging said pump through a discharge stroke includes spring means coactable with said plunger means.

32. The fuel priming system set forth in claim 29 wherein:

said plunger is connected to a plunger rod extending through a rod bore in a portion of said body, a part of said rod defining with said rod bore a fuel flow discharge passage adapted to be in communication with a passage opening into said rod bore and in communication with said conduit means for discharging fuel from said pump when said plunger means traverses said bore in said main body portion on a discharge stroke, and means associated with said rod for closing off fuel flow in communication with said passage means when said plunger means reaches a point on a suction stroke for filling said chamber with fuel from said tank.

33. The fuel priming system set forth in claim 32 wherein:

said plunger means includes a flexible cylindrical collar operable with a control edge of said bore in said main body to admit fuel to said chamber during a suction stroke of said plunger means and to delimit the effective displacement of said pump during a discharge stroke of said plunger means.

34. The fuel priming system set forth in claim 33 wherein:

said means associated with said rod includes resilient seal ring means located on said rod so as to be operable to prevent flow of fuel to said passage means when said plunger means moves out of sealing engagement with said control edge.

35. The combination comprising:

an internal combustion, reciprocating piston engine having an induction air passageway in which a subatmospheric pressure is developed when the piston is reciprocated;

a fuel tank for holding a supply of fuel;

a fuel reservoir holding a predetermined volume of fuel;

a conduit communicating from the reservoir through a metering orifice to the induction air passageway;

pressure compensating means for allowing fuel in the reservoir to be drawn from the reservoir through the metering orifice into the induction air passageway by subatmospheric pressure in the passageway resulting from reciprocation of the piston;

manually operable pump means for at will delivering a predetermined volume of fuel during each stroke from the fuel tank to the reservoir and to the metering orifice, the pump means including means for bypassing a portion of the fluid during each delivery stroke after the reservoir has been filled and fluid is being forced only through the metering orifice whereby the reservoir can be filled with a predetermined number of strokes and the lesser volumes of fuel delivered during successive strokes permits the use of multiple strokes to cover a wider range of engine temperature and climatic conditions with greater precision.

36. The combination comprising an internal combustion engine having a normal starting orientation with respect to the force of gravity, a fuel tank, induction air passageway means including carburetor means for carbureting fuel into the induction air during normal operation of the engine and valve means for admitting the fuel air mixture to the engine, a pump operated by pressure derived from stroking of the piston for pumping fuel from the tank to the carburetor, manually operable pump means for pumping fuel from the fuel tank to a section of the intake air passageway means between the air filter and valve means while bypassing the engine operated fuel pump, said section being oriented with respect to the force of gravity when the engine is in the normal starting position such that excess fuel drains by gravity away from the engine to provide fuel for initially starting the engine, and means for preventing the collection of excess fuel in the passageway other than a wetting of predetermined surfaces to provide a reproductable fuel-air mixture for starting the engine even in the event of excess operation of the manually operable pump means.

37. The combination of claim 36 further characterized by:

reservoir means for storing a predetermined volume of fuel pumped by the manually operable pump means, and means for feeding the predetermined quantity of fuel from the reservoir means to the intake air after the engine has started for maintaining operation of the engine until the carburetor means will maintain operation of the engine.

38. The combination comprising an internal combustion, reciprocating piston engine having a normal starting orientation with respect to the force of gravity including induction air passageway means for directing induction air to the engine, carburetor means for carbureting fuel into the induction air during normal operation, a fuel tank, manually operable pump means for pumping fuel from the fuel tank and injecting fuel in a section of the induction air passageway, said section being oriented with respect to the force of gravity when the engine is in the normal starting position such that excess fuel drains by gravity away from the engine, and drainage means for preventing accumulations of fuel other than wetting of the walls of a predetermined section of the passageway to provide an appropriate fuel-air ratio for starting the engine while limiting the potential for flooding.

39. The combination of claim 38 wherein:

with the engine in the normal starting orientation, the cylinder of the engine is disposed above the crankcase, the carburetion means is disposed generally below the crankcase and includes a butterfly valve disposed in the induction air passageway, the passageway extending upwardly toward the crankcase from the butterfly valve, and wherein the fuel is injected above the butterfly valve.

40. The combination of claim 38 further characterized by:

reservoir means for storing a predetermined volume of fuel pumped by the manually operable pump means, and means for feeding said predetermined quantity of fuel from the reservoir means to the induction air after the engine has started for maintaining operation of the engine until the carburetor means will maintain normal operation of the engine.

41. The combination of claim 40 further comprising:

engine operated pump means for pumping fuel from the tank to the carburetor means, and wherein the predetermined volumes of fuel stored in the reservoir means is sufficient to operate the engine until the engine operated pump means can establish named operation of the carburetor means.

42. The combination of claim 40 wherein:

the manually operable pump means pumps fuel into the induction air passageway through a restrictive metering orifice and also through a less restrictive passageway disposed upstream of the restrictive orifice into the reservoir, whereby the reservoir will be filled before appreciable fuel is injected into the induction air passageway.

43. The combination of claim 42 wherein:

the less restrictive passageway, the reservoir and the metering orifice are in series whereby the fuel is pumped through the restrictive metering orifice only after the reservoir is filled.

44. The combination of claim 42 wherein:

the manually operated pump means includes pressure relief means for bypassing fuel during the delivery strike of the pump when the reservoir is filled and the fuel is being forced through the restrictive orifice.

45. The combination of claim 44 wherein:

the travel of the manual pump means during the delivery stroke is limited to a predetermined time interval and force whereby a predetermined volume of fuel will be injected through the restrictive orifice during the deliver stroke when the reservoir is full.

46. The combination of claim 38 wherein:

the pump means includes means for preventing the flow of more than a predetermined quantity of fuel during each stroke even through the fuel tank may be above the atmospheric pressure present in the induction air passageway.

* * * * *